US008454102B2

(12) United States Patent
Kim

(10) Patent No.: US 8,454,102 B2
(45) Date of Patent: Jun. 4, 2013

(54) REFRIGERATOR

(75) Inventor: Myung Hwan Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 406 days.

(21) Appl. No.: 12/729,387

(22) Filed: Mar. 23, 2010

(65) Prior Publication Data

US 2011/0083461 A1 Apr. 14, 2011

(30) Foreign Application Priority Data

Oct. 13, 2009 (KR) ..... 10-2009-0097162

(51) Int. Cl.
*A47B 96/00* (2006.01)

(52) U.S. Cl.
USPC ..... 312/405; 312/319.5

(58) Field of Classification Search
USPC ..... 312/401, 405, 405.1, 319.2, 326, 312/329, 296, 324, 319.5, 319.8; 49/276, 49/277, 278; 62/265, 441, 449; 292/DIG. 71, 292/DIG. 72
See application file for complete search history.

(56) References Cited

U.S. PATENT DOCUMENTS

| | | | | |
|---|---|---|---|---|
| 3,734,589 | A * | 5/1973 | Morgan | 312/351 |
| 5,752,757 | A * | 5/1998 | Choi | 312/319.1 |
| 6,338,536 | B1 * | 1/2002 | Ueno et al. | 312/405 |
| 2006/0097612 | A1 * | 5/2006 | Park | 312/405 |
| 2006/0107597 | A1 * | 5/2006 | Jin et al. | 49/149 |
| 2008/0083243 | A1 * | 4/2008 | Lee et al. | 62/446 |
| 2008/0134698 | A1 * | 6/2008 | Cho et al. | 62/127 |
| 2010/0141107 | A1 * | 6/2010 | Kim et al. | 312/405 |

* cited by examiner

*Primary Examiner* — James O Hansen
(74) *Attorney, Agent, or Firm* — Fish & Richardson P.C.

(57) ABSTRACT

The embodiment relates to a refrigerator. The refrigerator according to the exemplary embodiment includes: a cabinet that includes at least one storage compartment; a plurality of doors that open and close the at least one storage compartment; a plurality of operating units that are provided at each door; and a door opening apparatus that is positioned at the cabinet and opens one of the plurality of doors corresponding to the operation of the plurality of operating units, wherein the door opening apparatus includes a driving motor, a power transfer unit that transfers power of the driving motor, and a plurality of push members each of which corresponds to the plurality of doors and are connected to the power transfer unit, and when the driving motor is operated, one of the plurality of push members pushes one of the plurality of doors.

18 Claims, 12 Drawing Sheets

REFRIGERATOR

The present application claims priority under 35 U.S.C. 119 and 35 U.S.C. 365 to Korean Patent Application No. 10-2009-0097162 (filed on 13 Oct. 2009), which is hereby incorporated by reference in its entirety.

BACKGROUND

The embodiment relates to a refrigerator.

Generally, a refrigerator is a device that stores foods in a low temperature state.

The refrigerator includes a cabinet that has a storage compartment formed therein and a door that opens and closes the storage compartment. The storage compartment may include a freezing compartment and a refrigerating compartment and the door may include a freezing compartment door and a refrigerating compartment door.

In order to shield the storage compartment, a gasket is provided at a rear surface of the door. When the door closes the storage compartment, the gasket is closely attached to the cabinet to prevent cold air inside the storage compartment from being leaked to the outside.

The cabinet is made of a metal material and an inner side of the gasket is provided with a magnet, such that the gasket may be closely attached to the cabinet. In order to open and close the storage compartment, a user pulls the door with a force larger than the attractive force of the magnet and the cabinet.

SUMMARY

Embodiments provide a refrigerator.

In one embodiment, a refrigerator including: a cabinet that includes at least one storage compartment; a plurality of doors that open and close the at least one storage compartment; a plurality of operating units that are provided at each door; and a door opening apparatus that is positioned at the cabinet and opens any one of the plurality of doors corresponding to the operation of the plurality of operating units, wherein the door opening apparatus includes a driving motor, a power transfer unit that transfers power of the driving motor, and a plurality of push members each of which corresponds to the plurality of doors and are connected to the power transfer unit, and when the driving motor is operated, any one of the plurality of push members pushes any one of the plurality of doors.

In another embodiment of the present invention provides a refrigerator including: a cabinet that includes at least one storage compartment; a first door and a second door that open and close the at least one storage compartment; a plurality of operating units that are provided at each door; a driving motor that is operated when any one of the plurality of operating units is operated; a power transfer unit that transfers power of the driving motor; a first push member that receives power of the power transfer unit and selectively pushes the first door; and a second push member that receives power of the power transfer unit and selectively pushes the second door.

The details of one or more embodiments are set forth in the accompanying drawings and the description below. Other features will be apparent from the description and drawings, and from the claims.

DETAILED DESCRIPTION OF THE EMBODIMENTS

Figure 1:
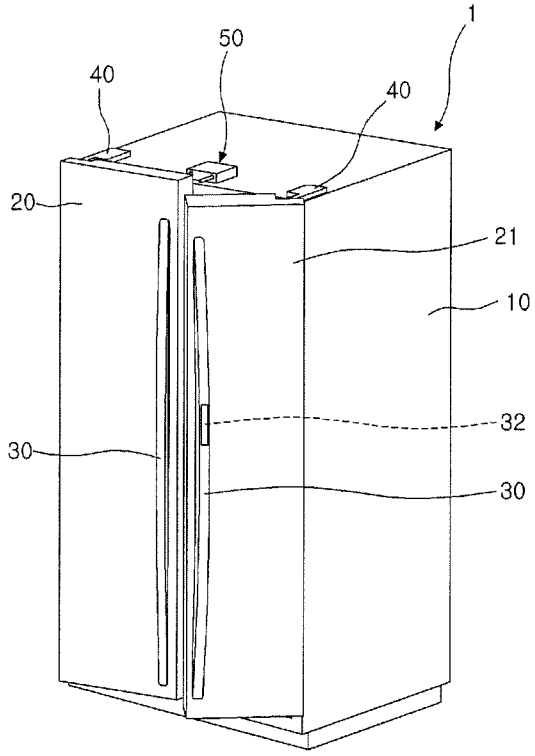
FIG. 1 is a perspective view of a refrigerator according to a first embodiment.

Reference will now be made in detail to the embodiments of the present disclosure, examples of which are illustrated in the accompanying drawings.

It is to be noted that in giving reference numerals to elements of each drawing, like reference numerals refer to like elements even though like elements are shown in different drawings. Further, in describing exemplary embodiments of the present invention, well-known functions or components will not be described in detail since they may unnecessarily obscure the understanding of the present invention.

In addition, in describing components of exemplary components of the present invention, terms such as first, second, A, B, (a), (b), etc. can be used. These terms are used only to differentiate the components from other components. Therefore, the nature, times, sequence, etc. of the corresponding components are not limited by these terms. In the case that any components are "connected', "coupled", or "joined" to other components, it is to be understood that the components may be directly or joined to other components but be "connected", "coupled", or "joined" to other components via another component.

FIG. 1 is a perspective view of a refrigerator according to a first embodiment.

Referring to FIG. 1, a refrigerator 1 according to the first embodiment includes a cabinet 10 that has one or more storage compartment formed therein and a plurality of doors 20 and 21 that opens and closes the storage compartment. The one or more storage compartment may include a freezing compartment and a refrigerating compartment. The freezing compartment and the refrigerating may be disposed in a left and right direction.

The plurality of doors 20 include the freezing compartment door 20 that opens and closes the freezing compartment and the refrigerating compartment door 21 that opens and closes the refrigerating compartment. Each of the doors 20 is provided with a door handle 30.

It is to be noted that the first embodiment describes a side by side type refrigerator by way of example and the idea of the first embodiment can be applied to all types of refrigerators that may include a plurality of doors.

Meanwhile, each door 20 and 21 or each door handle 30 may be provided with an operating unit 32 to which door opening signals are input. The operating unit 32 is operated by an operation of a user and a door opening apparatus 50 to be described later is operated by the operating unit 32. FIG. 1 shows a case where the operating unit 32 is provided at the door handle 30 by way of example. The operating unit 32 may include a sensing unit, a switch, etc.

Meanwhile, the door opening apparatus 50 is provided on an outer upper surface of the cabinet 10. The door opening apparatus 50 pushes the door 20 at the time of operating the operating unit 32, such that the doors 20 and 21 can open the storage compartment.

The door opening apparatus 50 may be disposed at a portion where a pair of doors 20 and 21 is adjacent to each other.

Figure 2:
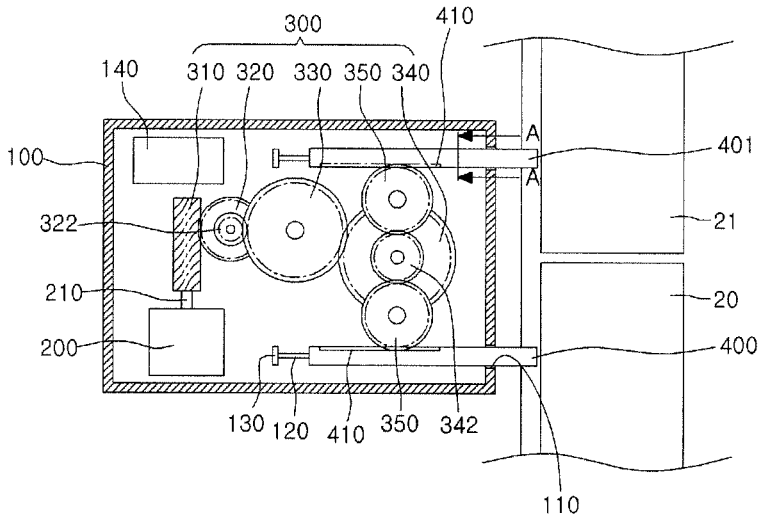
FIG. 2 is a diagram showing an inner structure of a door opening apparatus according to the first embodiment.

FIG. 2 is a diagram showing an inner structure of the door opening apparatus according to the first embodiment.

Referring to FIG. 2, the door opening apparatus 50 includes a case 100 that forms an outer appearance, a driving motor 200 that generates a driving force, a plurality of push members 400 and 401 that generates the driving force, and a power transfer unit 300 that transfers the rotating force of the driving motor 200 to the plurality of push members 400 and 401.

In detail, the case 100 is mounted on the upper surface of the cabinet 10 and the front surface of the case 100 may be formed with a plurality of holes 100 through which each push member 400 and 401 can penetrate.

The driving motor 200 is a motor that can be rotated in a forward and reverse direction. A rotating shaft 210 of the driving motor 200 extends in a direction intersecting with each push member 400. The operation transfer unit 300 is connected to the rotating shaft 210 of the driving motor 200.

The plurality of push members 400 and 401 includes a first push member 400 that pushes the refrigerating compartment door 20 and a second push member 401 that pushes the refrigerating compartment door 21. Each push member 400 and 401 is connected to the power transfer unit 300 at a position spaced from each other. The plurality of push members 400 and 401 are disposed in parallel.

In detail, the plurality of push members 400 and 401 extend in a forward and backward direction of the refrigerator 1. The plurality of push members 400 and 401 contacts or is spaced to and from the rear surface of each door 20 in a neutral state and when the operating unit 32 is operated, at least one push member 400 and 401 moves to at least one door 20 and 21 to push the doors 20 and 21.

A portion of each push member 400 and 401 is protruded to an outer side of the case 110 through each hole 110 of the case 100. Each push member 400 is formed with a rack gear 410. The rack gear 410 is connected to the power transfer unit 300. Therefore, the rack gear 410 may be referred to a connection unit.

Meanwhile, the power transfer unit 300 is provided inside the case 100. The power transfer unit 300 includes a plurality of gears. The plurality of gears includes a worm gear 310 that is connected to the rotating shaft 310 of the driving motor 200 and a first gear 320 to a fourth gear 350.

In detail, the first gear 320 is engaged with the worm gear 310. The rotating shaft of the first gear 320 intersects with the plurality of push members 400 and 401 and the rotating shaft 210 of the driving motor 200. The first gear 320 includes an upper gear 322 that is engaged with the second gear 330. A diameter of the upper gear 322 is smaller than that of the second gear 330. The second gear 330 is engaged with a third gear 340. The third gear 340 includes the upper gear 342 that is engaged with a plurality of fourth gears 350.

The plurality of fourth gears 350 are engaged with the upper gear 342 at a position spaced from each other. The plurality of fourth gears 350 are disposed at an opposite side based on the upper gear 342.

Any one of the plurality of fourth gears 350 is connected to the rack gear of the first push member 400 and the other one of the plurality of fourth gears 350 is connected to the rack gear of the second push member 401.

As described above, the plurality of gears other than the worm gear 310 has a spur gear form and the rotating force of the driving motor 200 is transferred to the push members 400 and 401 by a combination of gears having different gear ratios.

At this time, the plurality of push members is selectively advanced and reversed according to the forward and reverse rotation of the driving motor 200 and when any one push member moves in one direction, the other push member moves in an opposite direction.

Meanwhile, the case 100 is formed with a plurality of moving guides 120 that guide a front and rear direction movement of each push member 400 and 401. The rear end of each moving guide 120 may be formed with a stopper 130 that limits the backward movement of each push member 400.

Figure 3:
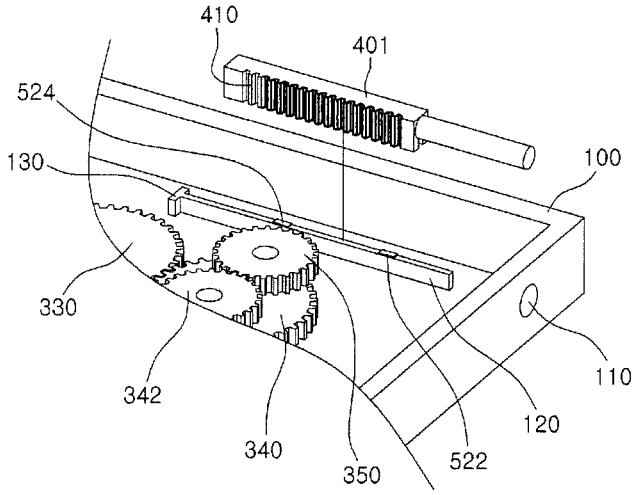
FIG. 3 is a partially exploded perspective view showing a configuration of the door opening apparatus according to the first embodiment.
Figure 4:
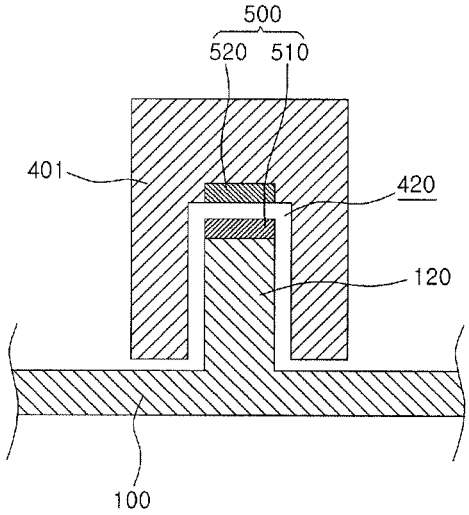
FIG. 4 is a cross-sectional view taken along line A-A of FIG. 1.

FIG. 3 is a partial perspective view of a configuration of the door opening apparatus according to the first embodiment and FIG. 4 is a cross-sectional view taken along line A-A' of FIG. 1.

Referring to FIGS. 2 to 4, each moving guide 120 extends in parallel with the moving direction of each push member 400.

Each moving guide 120 may be integrally formed with the case 100 and may be protruded upward from the case 100. Unlike this, the moving guide 120 may be coupled to the case 100 by a screw, a hook, etc.

The moving guide 120 is received in a receiving part 420 that is depressedly formed in the push members 400 and 401. The stopper 130 extends in a direction intersecting with an extending direction of the moving guide 120 from the end of the moving guide 120.

Meanwhile, the position change due to the movement of the push members 400 and 401 can be sensed by a position sensing mechanism 500. The rotating direction of the driving motor 200 is determined according to the position of the push members 400 and 401 sensed by the position sensing mechanism 500.

The position sensing mechanism 500 includes one or more position confirming unit 510 that is provided at any one of the plurality of push members 400 and 401 and one or more sensing unit 520 that is provided at the case 100 or the moving guide 120. For example, the position confirming unit 510 may be positioned in the receiving part and the sensing unit 520 may be positioned at the moving guide 120.

The first embodiment will describe a case where the position confirming unit 510 is provided at the second push member 401. Of course, the position confirming unit 510 is provided at the first push member 400 and the sensing unit 520 may be provided at the moving guide or the case corresponding to the first push member 400. In addition, the position confirming unit 510 may be provided at each push member 400 and 401 and the sensing unit 520 may be provided at the moving guide 120 or the case, respectively.

The sensing unit 520 may be any one of a switch, a hole sensing unit, a photo sensing unit, etc. The position confirming unit 510 may have any configuration such as a protruding part, a magnet, a groove, etc. that can be recognized by the sensing unit 520.

Figure 5:
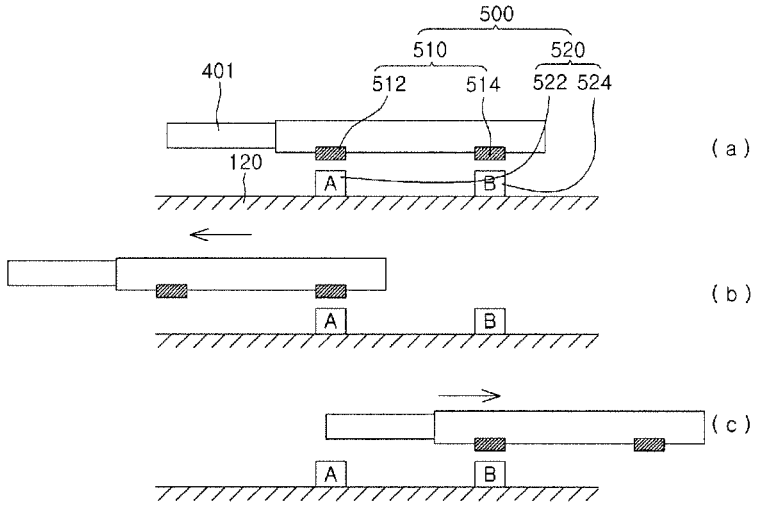
FIG. 5 is a diagram showing a shape where a position of the push member according to the first embodiment is changed.
Figure 6:
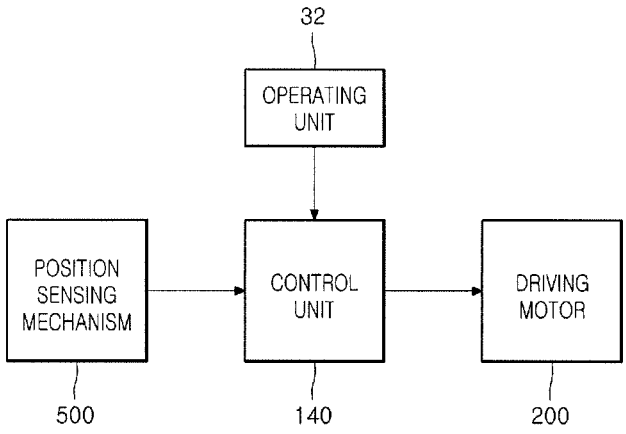
FIG. 6 is a block diagram showing a structure of controlling a refrigerator according to the first embodiment.

FIG. 5 is a diagram showing a shape where the position of the push member according to the first embodiment is changed and FIG. 6 is a block diagram showing a control structure of the refrigerator according to the first embodiment.

Referring to FIGS. 3 to 6, the second push member 401 may be provided with the plurality of position confirming units 510 by way of example. The plurality of position confirming units 510 includes a first position confirming unit 512 and a second position confirming unit 514. The plurality of position confirming units 510 are disposed to be spaced in a parallel direction with the extending direction of the second push member 401.

In addition, the moving guide 120 corresponding to the second push member may include the plurality of sensing units 520 by way of example. The plurality of sensing units 520 include a first sensing unit 522 and a second sensing unit 524. The plurality of sensing units 520 is disposed to be spaced in a parallel direction with the extending direction of the moving guide 120. A spaced distance between the plurality of position confirming units 510 is the same as a spaced distance between the plurality of sensing units 520.

Meanwhile, when the operating unit is operated, signals from the operating unit 32 are transferred to the control unit 140. Then, the control unit 140 drives the driving motor 200. The signals sensed in the position sensing mechanism 500 are transferred to the control unit 140 and the control unit controls the driving motor 200 according to the signals of the position sensing mechanism 500.

In the first embodiment, as shown in FIG. 5A, when the first and second position confirming units 512 and 514 are sensed by the first and second sensing units 522 and 524, respectively, the control unit 140 is determined that the second push member 401 is positioned at an initial position, that is, a neutral position. When any one of the push members 400 and 401 is positioned at the neutral position, the other one of push members 400 and 401 is positioned at the neutral position.

As shown in FIG. 5B, when the second position confirming unit 514 is sensed in the first sensing unit 522, the control unit 140 is determined that the second push member 401 maximally moves forward. When any one of the push members 400 and 401 maximally moves forward, the other one of the push members 400 and 401 maximally moves backward.

On the other hand, as shown in FIG. 5C, when the first position confirming unit 512 is sensed in the second sensing unit 524, the control unit 140 is determined that the second push member 401 maximally moves backward.

In the first embodiment, moving the push members 400 and 401 forward means a direction where the push members 400 and 401 approaches to the door or a direction which pushes the door and moving the push members 400 and 401 backward means a direction where the push member is away from the door.

Figure 7:
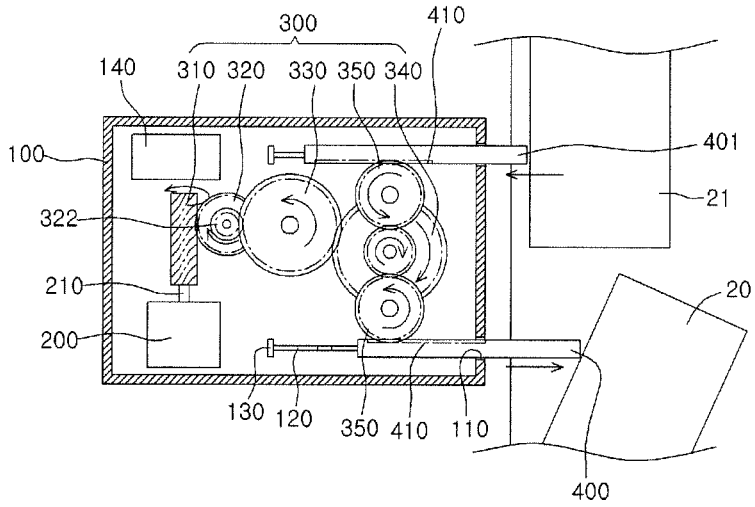
FIG. 7 is a diagram showing a state where a freezing compartment door according to the first embodiment is opened.
Figure 8:
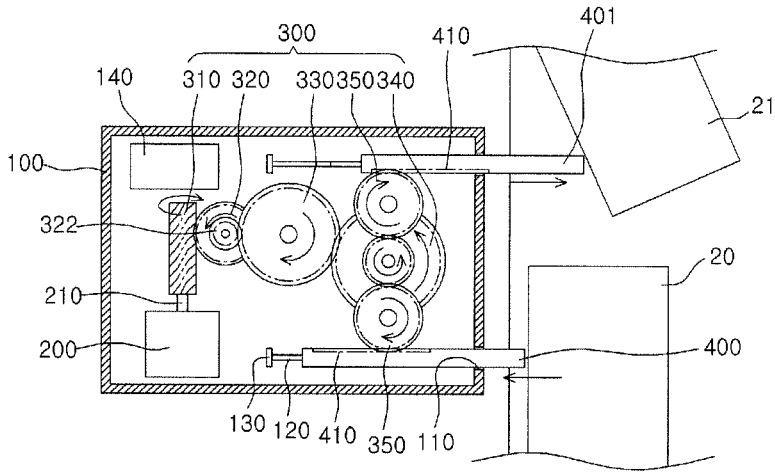
FIG. 8 is a diagram showing a state where a refrigerating compartment door according to the first embodiment is opened.

FIG. 7 is a diagram showing a state where the freezing compartment door according to the first embodiment is opened and FIG. 8 is a diagram a state where the refrigerating compartment door according to the first embodiment is opened.

FIGS. 1 to 7, in the state where the freezing compartment and the freezing compartment are opened, each push member 400 and 401 contacts or is spaced to and from each door 20 and 21.

In this state, as shown in FIG. 5A, each position confirming unit 512 and 514 is sensed in each sensing unit 522 and 524.

First, in order to open the freezing compartment door 20, when the operating unit 32 provided at a handle of the freezing compartment door 20 is operated, signals for opening the freezing compartment door is transferred to the control unit.

The control unit 140 controls the driving motor 200 to rotate the rotating shaft 210 of the driving motor 200 in one direction. When the rotating shaft 210 of the driving motor 200 is rotated in one direction, the worm gear 310 is rotated in one direction.

When the worm gear 310 is rotated in one direction, the first gear 320 is rotated clockwise by way of example. The second gear 330 is rotated counterclockwise, the third gear 340 is rotated clockwise, and the plurality of fourth gears 350 are rotated counterclockwise.

At this time, since the first gear 320 to the fourth gear 350 has different gear ratios, they can be rotated at a relatively low speed even though the driving motor 200 is rotated at a high speed, thereby making it possible to make a force, which is transferred to each push member 400 and 401, large.

When the plurality of fourth gears 350 are rotated counterclockwise, the first push member 400 moves forward to push the refrigerating compartment door 20 and second push member 401 moves backward.

While the second push member 400 moves backward, the first position confirming unit 512 is sensed by the second sensing unit 524 corresponding to the second push member 401. The control unit 140 controls the driving motor to rotate the rotating shaft of the driving motor 200 in the other direction to return each push members 400 and 401 to the initial position.

The first push member 400 moves backward and the second push member 401 moves forward. When each sensing unit 522 and 524 senses each position confirming units 512 and 514 during the movement of each push member, the control unit 140 stops the driving motor 200.

On the other hand, in order to open the refrigerating compartment door 21, when the operating unit 32 provided at the handle of the refrigerating compartment door 21 is operated, the signals for opening the refrigerating compartment door is transferred to the control unit 140. The first push member moves backward and the second push member 401 moves forward such that the second push member 401 pushes the refrigerating compartment door 20. The operation of the door opening apparatus during the opening process of the freezing compartment door is opposite to the operation of the door opening apparatus during the opening process of the freezing compartment door and therefore, the detailed description thereof will be omitted.

According to the first embodiment, the push member pushes the door which should be opened, thereby making it possible to reduce force applied to allow a user to pull the door. Therefore, the user can easily open the door.

In addition, since the refrigerating compartment door or the freezing compartment door can be opened by one driving motor, thereby simplifying the structure.

The first embodiment describes a case of opening the freezing compartment door or the refrigerating compartment door. To the contrary, the first embodiment can open the plurality of freezing compartment doors or the plurality of refrigerating compartment doors. In other words, the idea of the first embodiment includes a fact that any one of the plurality of doors that opens and closes one or more storage compartment is opened by a single door opening apparatus. Therefore, any one of the plurality of doors may be referred to a first door and the other one of the plurality of doors may be referred to a second door.

Figure 9:
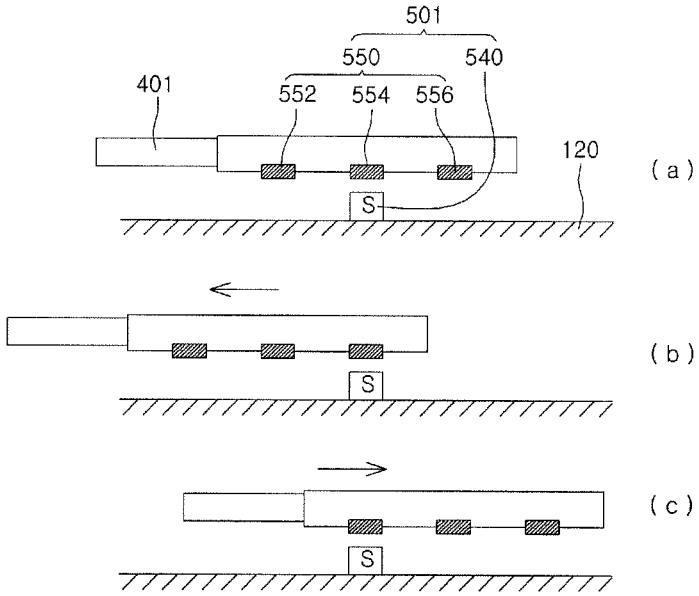
FIG. 9 is a diagram showing a shape where a position of the push member according to a second embodiment is changed.

FIG. 9 is a diagram showing a shape where the position of the push member according to a second embodiment is changed.

The components of the second embodiment are the same as those of the first embodiment except for a difference only in the position sensing mechanism. Therefore, only the feature components of the second embodiment will be described.

Referring to FIG. 9, the position sensing mechanism 501 according to the second embodiment includes a plurality of position confirming units 550 that are included in the second push member 401 and a single sensing unit 540 that is included in the moving guide corresponding to the second push member 401, by way of example.

The plurality of position confirming units 550 include first to third position confirming units 552, 554, and 556.

The second position confirming unit 554 is sensed in the sensing unit 540 in the state where the second push member 401 is positioned at an initial position. The first position confirming unit 554 is sensed in the sensing unit 540 in the state where the second push member 401 maximally moves forward. On the other hand, the third position confirming unit 556 is sensed in the sensing unit 540 in the state where the second push member 401 maximally moves backward.

Figure 10:
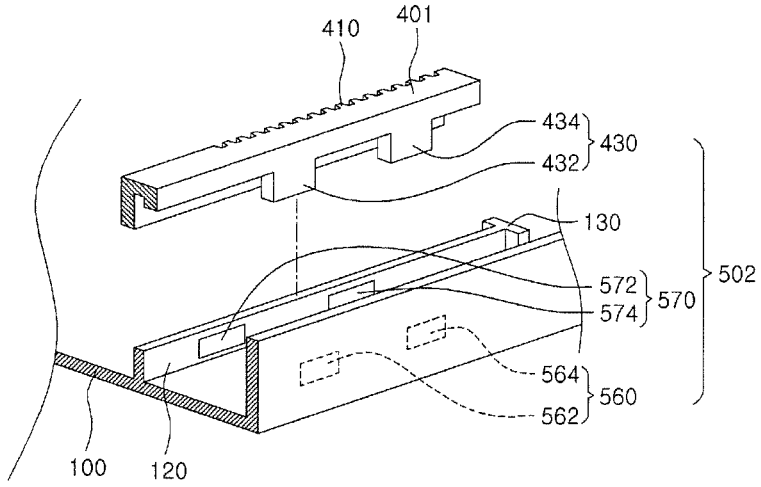
FIG. 10 is a partial perspective view showing a position sensing mechanism according to a third embodiment.

FIG. 10 is a partial perspective view showing a position sensing mechanism according to a third embodiment.

The components of the third embodiment are the same as those of the first embodiment except for a difference only in the position sensing mechanism. Therefore, only the feature components of the present embodiment will be described.

Referring to FIG. 10, the position sensing mechanism 502 according to the third embodiment includes a light emitting unit 560 (performing a role of the position confirming unit) that emits light, a light receiving unit 570 (performing a role of the sensing unit) that senses light emitted from the light emitting unit 560, and a blocking unit 430 that blocks light emitted from the light emitting unit 560.

In detail, the light emitting unit 560 is included in the case 100 and may be positioned at the side of the second push member 401 by way of example. The light emitting unit 560 emits light to the second push member 401. The light emitting unit 560 includes a first light emitting unit 562 and a second light emitting unit 564 that is spaced from the first light emitting unit 562.

The light receiving unit 570 is provided at one side of the moving guide 120 corresponding to the second push member 401. The light receiving unit 570 includes a first light receiving unit 572 and a second light receiving unit 574 that is spaced from the first light receiving unit 572.

The blocking unit 430 may be formed at the side of the second push member 401. The blocking unit 430 includes a first blocking unit 432 and a second blocking unit 434 that is spaced from the first blocking unit. A distance between the first blocking unit 432 and the second blocking unit 434 is the same as a distance between the first light emitting unit 562 and the second light emitting unit 564. In addition, the distance between the first light emitting unit 562 and the second light emitting unit 564 is the same as the distance between the first light receiving unit 572 and the second light receiving unit 574.

Each blocking unit 432 and 434 may extend downward from the second push member 401.

When the second push member 401 is positioned at the initial position, each blocking unit 432 and 434 blocks light from each light emitting unit 562 and 564. In other words light from each light emitting units 562 and 564 is not sensed in the light receiving unit 570.

When the second push member 400 maximally moves forward, the second blocking unit 434 blocks light from the first light emitting unit 562. Therefore, the second light receiving unit 574 senses light from the second light emitting unit 564.

On the other hand, when the second push member 400 maximally moves backward, the first blocking unit 432 blocks light from the second light emitting unit 564. Therefore, the first light receiving unit 572 senses light from the first light emitting unit 562.

Figure 11:
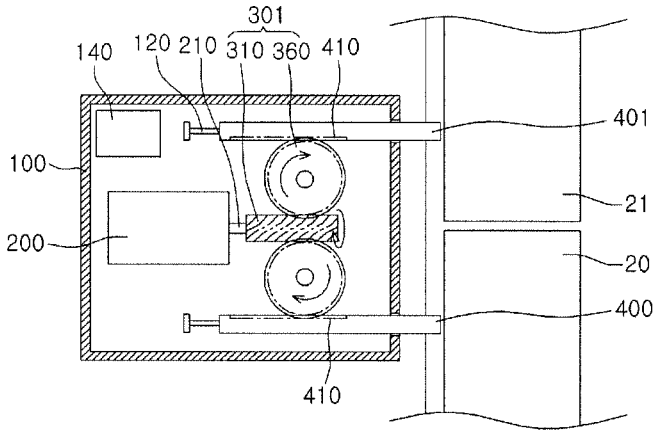
FIG. 11 is a diagram showing a door opening apparatus according to a fourth embodiment.

FIG. 11 is a diagram showing a door opening apparatus according to a fourth embodiment.

The fourth embodiment is the same as any one of the foregoing embodiments in other components except for a difference only in a structure that the power of the driving motor is transferred to each push member. Therefore, only the feature components of the present embodiment will be described.

Referring to FIG. 11, the door opening apparatus according to the fourth embodiment includes the driving motor 200 and the power transfer unit 301 that transfers the power of the driving motor 200 to the plurality of push members 400 and 401.

In detail, the power transfer unit 301 includes the worm gear that is connected to the rotating shaft 210 of the driving motor 200 and a plurality of transfer gears 360 that are connected to the worm gear and the respective push members 400 and 401. The worm gear 310 is positioned between the plurality of transfer gears 360.

According to the fourth embodiment, it is an advantage in that the structure of the power transfer unit is simplified.

Figure 12:
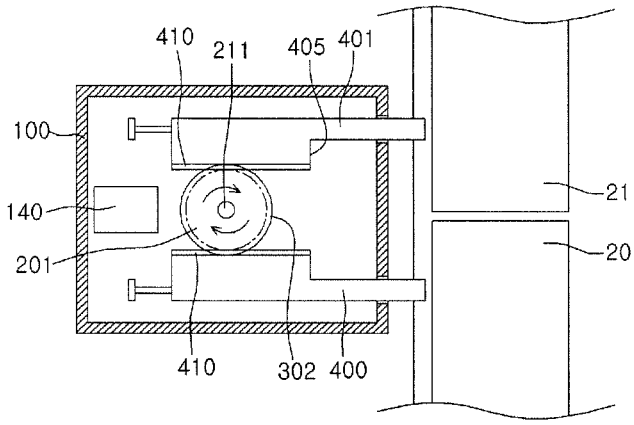
FIG. 12 is a diagram showing a door opening apparatus according to a fifth embodiment.

FIG. 12 is a diagram showing a door opening apparatus according to a fifth embodiment.

The fifth embodiment is the same as any one of the first to third embodiments in other components except for a difference only in a structure that the power of the driving motor is transferred to each push member. Therefore, only the feature components of the present embodiment will be described.

Referring to FIG. 12, the door opening apparatus according to the fifth embodiment includes the driving motor 201 and the power transfer unit 302 that transfers the power of the driving motor 200 to the plurality of push members 400 and 401. As the driving motor 201, a piezo motor having a thickness thinner than a general DC motor may be used.

The driving motor 200 is positioned between the plurality of push members 400 and 401. At this time, the rotating shaft 211 of the driving motor 201 extends in a direction intersecting with the extending direction of each push member 400 and 401.

The power transfer unit 302 includes a single gear that is connected to the driving motor and the respective members 400 and 401.

The respective push members 400 and 401 is provided with a protruding portion 405 that is protruded to the power transfer unit 302 and the protruding portion 405 may be formed with the rack gear 410.

The foregoing described the case where all the components configuring the exemplary embodiments of the present invention are operated by being coupled in one body, but the present invention is not necessarily limited to the exemplary embodiments. In other words, one or more of all the components may be selectively coupled and operated in the object of the present invention. In addition, terms such as "comprising", "configuring", or "having" described above mean including the corresponding components unless indicated otherwise and thus, it is to be construed that terms may further include other components rather than excluding other components. Unless indicated otherwise, it is to be understood that all the terms used in the specification including technical and scientifical terms have the same meaning as those that are generally understood by those skilled in the art. Like terms defined in a dictionary, it is to be construed that generally used terms conform to a context of a related technology and unless being definitively defined in the present invention, terms are not construed as excessively formal meanings.

The technical spirit of the present invention has been just exemplified. It will be appreciated by those skilled in the art that various modifications, changes, and substitutions can be made without departing from the essential characteristics of the present invention. Accordingly, the embodiments disclosed in the present invention and the accompanying drawings are used not to limit but to describe the spirit of the present invention. The scope of the present invention is not limited only to the embodiments and the accompanying drawings. The protection scope of the present invention must be analyzed by the appended claims and it should be analyzed that all spirits within a scope equivalent thereto are included in the appended claims of the present invention.

What is claimed is:

1. A refrigerator, comprising:

a cabinet that includes at least one storage compartment;

a plurality of doors that open and close the at least one storage compartment;

a plurality of operating units that are provided at each door; and a door opening apparatus that is positioned at the cabinet and opens any one of the plurality of doors corresponding to the operation of the plurality of operating units, wherein the door opening apparatus includes a driving motor, a power transfer unit that transfers power of the driving motor, a plurality of push members each of which corresponds to the plurality of doors and are connected to the power transfer unit, and a plurality of moving guides that guide the movement of each push member, when the driving motor is operated, any one of the plurality of push members pushes any one of the plurality of doors, wherein each push member comprises a rack gear and the power transfer unit comprises at least one pinion gear engaged with the rack gear to transfer power of the driving motor to the rack gear, wherein at least one of the plurality of push members comprises a plurality of position confirming units that are spaced apart from each other and at least one of the plurality of moving guides comprises at least one sensing unit that senses one or more of the plurality of position confirming units, and wherein the power transfer unit comprises a worm gear that is connected to a rotating shaft of the driving motor and a plurality of pinion gears that are rotated based on rotation of the worm gear.

2. The refrigerator according to claim 1, wherein when the driving motor is operated, the plurality of push members move in an opposite direction to each other.

3. The refrigerator according to claim 1, wherein the plurality of push members are disposed in parallel.

4. The refrigerator according to claim 1, wherein each push member is provided with a receiving part in which each moving guide is received.

5. The refrigerator according to claim 1, wherein the plurality of push members are disposed to be spaced from each other and the power transfer unit is disposed between the plurality of push members.

6. The refrigerator according to claim 1, wherein when any one of the plurality of position confirming units is sensed by the at least one sensing unit, the driving motor stops, and when the other one of the plurality of position confirming units is sensed, the rotation direction of the driving motor is changed.

7. The refrigerator according to claim 1, wherein the position sensing mechanism includes:

a plurality of light emitting units that emit light and are disposed to be spaced from each other, a plurality of light receiving units that receive light and are spaced from each other, and a plurality of blocking units that selectively block light emitted from the plurality of light emitting units.

8. The refrigerator according to claim 1, wherein the plurality of pinion gears comprise:

a first gear;

a second gear;

a third gear; and a plurality of fourth gears, wherein the first gear is engaged with the worm gear and includes an upper gear that is engaged with the second gear, wherein the second gear is engaged with the third gear, wherein the third gear includes an upper gear that is engaged with the plurality of fourth gears, wherein the plurality of fourth gears are engaged with the upper gear of the third gear at a position spaced from each other and the plurality of fourth gears are disposed at opposite sides of the upper gear of the third gear, and wherein a first of the plurality of fourth gears is connected to the rack gear of a first of the plurality of push members and a second of the plurality of fourth gears is connected to the rack gear of a second of the plurality of push members.

9. The refrigerator according to claim 8, wherein a diameter of the upper gear of the first gear is smaller than a diameter of the second gear.

10. The refrigerator according to claim 8, wherein the first gear, the second gear, the third gear, and the plurality of fourth gears each have a spur gear form and the rotating force of the driving motor is transferred to the push members by a combination of gears having different gear ratios.

11. The refrigerator according to claim 1, wherein the at least one sensing unit that senses one or more of the plurality of position confirming units comprises a plurality of sensing units disposed to be spaced in a parallel direction with an extending direction of the moving guides, and wherein a spaced distance between the plurality of position confirming units is the same as a spaced distance between the plurality of sensing units.

12. A refrigerator, comprising:

a cabinet that includes at least one storage compartment;

a first door and a second door that open and close the at least one storage compartment;

a plurality of operating units that are provided at each door;

a driving motor that is operated when any one of the plurality of operating units is operated;

a power transfer unit that transfers power of the driving motor;

a first push member that receives power of the power transfer unit and selectively pushes the first door;

a second push member that receives power of the power transfer unit and selectively pushes the second door;

a first moving guide that guides movement of the first push member; and a second moving guide that guides movement of the second push member, wherein a rear end of the first moving guide has a first stopper that limits backward movement of the first push member, and wherein a rear end of the second moving guide has a second stopper that limits backward movement of the second push member.

13. The refrigerator according to claim 12, wherein when the driving motor is operated, one of the first and second push members pushes one of the first and second doors and the other of the first and second push members is moved away from the other of the first and second doors.

14. The refrigerator according to claim 13, further comprising:

a position sensing mechanism that senses the position change of at least one of the first and second push members, wherein when one of the first and second push members moves by a predetermined distance by rotation of the rotating shaft of the driving motor in a first direction, the rotating shaft of the driving motor is rotated in an opposite second direction.

15. The refrigerator according to claim 12, wherein when the driving motor is operated, the respective push members move simultaneously and move in an opposite direction to each other.

16. The refrigerator according to claim 12, wherein the power transfer unit includes at least one gear.

17. The refrigerator according to claim 16, wherein each push member includes a connection unit that is connected to the at least one gear.

18. A refrigerator, comprising:

a cabinet that includes at least one storage compartment;

a plurality of doors that open and close the at least one storage compartment;

a plurality of operating units that are provided at each door; and a door opening apparatus that is positioned at the cabinet and opens any one of the plurality of doors corresponding to the operation of the plurality of operating units, wherein the door opening apparatus includes a driving motor, a power transfer unit that transfers power of the driving motor, a plurality of push members each of which corresponds to the plurality of doors and are connected to the power transfer unit, and a plurality of moving guides that guide the movement of each push member, when the driving motor is operated, any one of the plurality of push members pushes any one of the plurality of doors, wherein each push member comprises a rack gear and the power transfer unit comprises at least one pinion gear engaged with the rack gear to transfer power of the driving motor to the rack gear, wherein at least one of the plurality of push members comprises a plurality of position confirming units that are spaced apart from each other and at least one of the plurality of moving guides comprises at least one sensing unit that senses one or more of the plurality of position confirming units, and wherein a rear end of each moving guide has a stopper that limits backward movement of at least one of the push members.

* * * * *